United States Patent [19]

Dale

[11] Patent Number: 4,958,650

[45] Date of Patent: Sep. 25, 1990

[54] WALKING AND SKIING AID

[76] Inventor: Hal J. Dale, 7 S. Arizona, Dillon, Mont. 59725

[21] Appl. No.: 279,879

[22] Filed: Dec. 5, 1988

[51] Int. Cl.[5] ..... A45B 1/00

[52] U.S. Cl. ..... 135/65; 280/819; 280/821

[58] Field of Search ..... 280/813, 819, 821, 823, 280/824; 135/65, 76, 82

[56] References Cited

U.S. PATENT DOCUMENTS

| | | | |
|---|---|---|---|
| 3,436,090 | 4/1969 | Lang | 280/821 |
| 3,933,364 | 1/1976 | With | 280/821 |
| 4,196,742 | 4/1980 | Owen | 280/821 |
| 4,620,723 | 11/1986 | Joseph | 280/821 |
| 4,787,652 | 11/1988 | Pronzati | 280/824 |

FOREIGN PATENT DOCUMENTS

| | | | |
|---|---|---|---|
| 178317 | 9/1953 | Austria | 280/819 |
| 1390129 | 1/1965 | France | 280/821 |
| 1519298 | 2/1968 | France | 280/819 |
| 98588 | 4/1940 | Sweden | 280/819 |
| 115448 | 11/1944 | Sweden | 280/819 |
| 197805 | 3/1976 | Switzerland | 280/819 |

OTHER PUBLICATIONS

Skying Magazine, Nov. 1988; copy in 280/819; 2591908—1/26/87—France—Julien—280/821/1/2.

*Primary Examiner*—Henry E. Raduazo

[57] ABSTRACT

A walking and skiing aid is disclosed. The invention provides a tapered, elongate rod having a ground engaging tip end and an upper gripping end. The gripping end is canted forwardly and turned inwardly so that the alignment of the user's wrist is in an osteologically correct position. Additionally, the lower ground engaging tip is canted forwardly to provide for a longer duration of ground engagement while utilizing the walking and skiing aid. Additional embodiments for skiing, walking, and geriatric use are also disclosed.

11 Claims, 4 Drawing Sheets

WALKING AND SKIING AID

BACKGROUND OF THE INVENTION

1. Field of the Invention

This invention relates to a walking and skiing aid, and in particular, to a walking stick and ski pole that are osteologically correct.

2. Discussion of the Technical Problems

Walking aids have been used by people since the beginning of time. The most common aid employed is the walking stick which is merely a length of wood which a walker grasps by one end and urges against the ground to aid in walking over uneven ground. In a like manner, ski poles have been in use since the dawn of skiing to aid both Nordic (cross country) as well as Alpine (downhill) skiing. The cross country skiing aid is used by the cross country skier to help propel him across the ground as it allows the cross country skier to utilize the muscles in the upper body to provide propulsion. Prior art cross country ski poles are generally of the type utilizing a straight pole or stick having a grip on one end and a strap associated with the grip Many experienced cross country skiers actually press against the strap rather than the pole in order to utilize the cross country pole effectively.

Downhill skiers utilize ski poles to aid in making turns as well as maintaining balance Downhill ski poles are generally carried with the tips above the surface of the snow until the skier wishes to "plant" the pole in order to facilitate a turn.

Unfortunately, ordinary sticks and poles having straight, elongate tubes or rods when grasped by a walking or skiing person force that person to change the natural wrist angle to be more in alignment with the pole and not in the natural alignment of the human bone structure. Additionally, straight walking sticks and poles will often employ pointed tips that do not allow for tip placement ahead of a straight line to encourage further reaching, but rather provide a straight line engagement with the ground.

The lower extremity of the bones of the forearm including the ulna and radius are attached to the wrist joint at a particular angle so that when the fingers of the hand grasp a pole or stick the longitudinal axis of the stick places the point of a straight, elongate stick behind the user. In order to bring the point of a straight stick forward, so that it could be used as an improved aid in walking or skiing, the wrist must be bent backwards to an angle that is both uncomfortable and unnatural for the condition of the human skeleton. Accordingly, a more natural position for a walking stick or skiing aid is to have the handle or gripping surface canted forwardly approximately from 10 to 20 degrees. Additionally, it has been found that the bones of the hand and wrist in a natural, relaxed state turn slightly inward so that the gripping surface should be also tilted slightly inwardly to create a more relaxed natural position for gripping.

It has also been found if the ground engaging point were canted slightly forward, then the point of the walking or skiing aid would maintain longer and more useful contact with the ground than if it were not canted forwardly.

Prior art ski poles and walking sticks are generally of the straight type and have different gripping surfaces, straps, and points.

The ideal walking and skiing aid would provide a naturally occurring gripping surface while maintaining a walking stick in the correct osteological angle commensurate with the human skeleton and would provide for a forwardly projecting ground engaging surface so that the device could be used to provide more thrust over a longer duration of time.

Very few devices in the known art relate to walking and skiing aids and none known are directed to providing a walking and skiing aid having a naturally osteologically correct position of the gripping surface, that being both forwardly canted and inwardly twisted while maintaining the ground engaging point forwardly from the longitudinal axis of the main portion of the walking stick.

Accordingly, a need exists for such a walking and skiing aid that would provide a safe, convenient osteologically correct gripping surface for aiding walkers and skiers and yet would provide the longest duration of ground engaging contact possible. Such a walking and skiing aid would provide a simple, inexpensive apparatus that could be utilized by walkers, downhill skiers, cross country skiers, as well as old and infirm persons. Such a device should be uncomplicated in design, easily repaired, not subject to damage by proper use, and simple to manufacture. The instant invention is directed to all these needs as well as to others as explained in the following summary.

SUMMARY OF THE INVENTION

It is a feature of the invention to provide a walking and skiing aid.

It is another feature of the instant invention to provide a walking and skiing aid having a forwardly angled and inwardly canted gripping surface.

It is another feature of the instant invention to provide a walking and skiing aid having a forwardly projecting lower point.

These and other features and objects are attained according to the instant invention by providing a walking and skiing aid having a forwardly canted gripping surface and a forwardly canted ground engaging surface. The invention provides an elongate tube or rod being tapered toward the ground engaging lower end and having a gripping surface on the upper end. The upper gripping surface is canted forwardly and inwardly and the lower ground engaging surface is canted forwardly. The upper inwardly and forwardly cant as well as the forwardly cant of the ground engaging surface are provided by bending the tapered elongate pole at the appropriate positions along its length. In its primary embodiment, the walking and skiing aid is provided with a cushion grip surface attached to the elongate rod as well as a wrist engaging strap. The canting and bending of the pole can be best described as having a bend near the upper gripping surface, a bend near the lower ground engaging surface, and a twist near the upper gripping surface.

BRIEF DESCRIPTION OF THE DRAWINGS

The advantages of this invention will become apparent upon consideration of the following detailed disclosure of the invention, especially when taken in conjunction with the accompanying drawings, wherein.

DESCRIPTION OF THE PREFERRED EMBODIMENT

Figure 1:
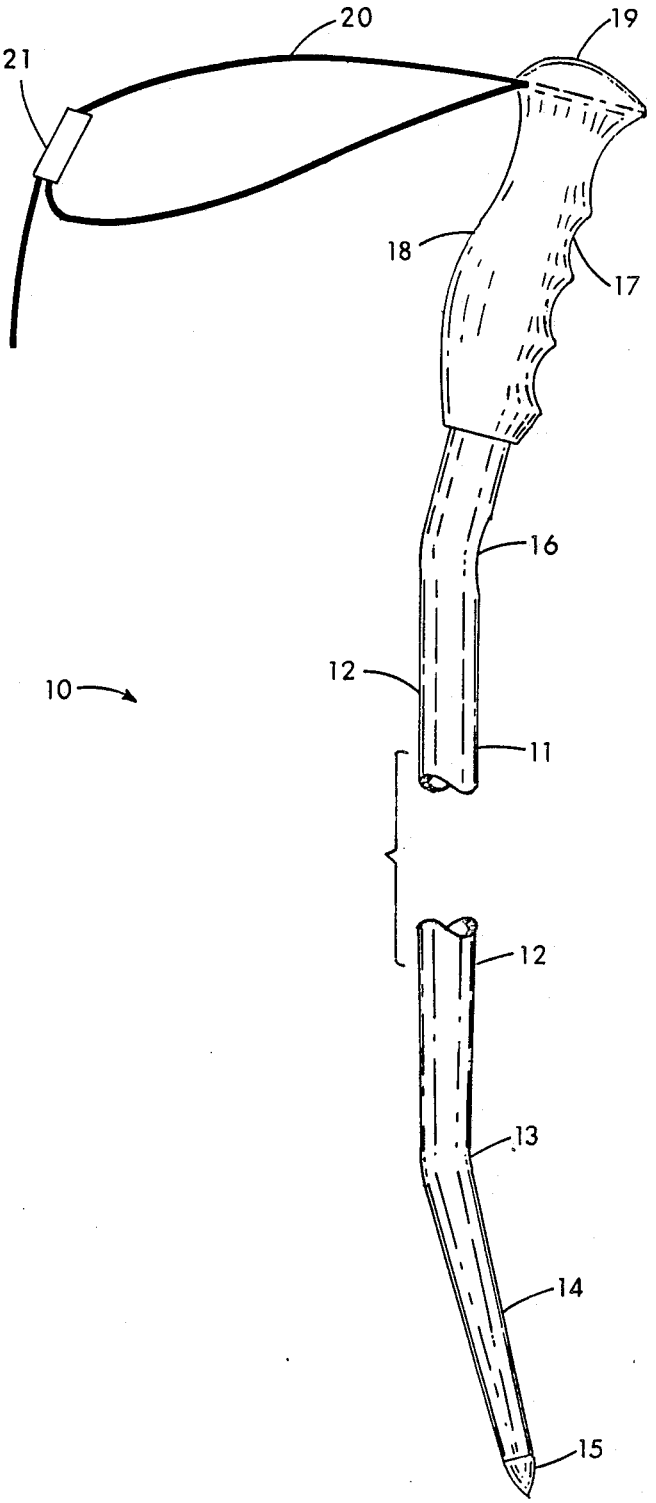
FIG. 1 is a shortened side elevational view of the walking and skiing aid in which the forwardly canted gripping end and the forwardly canted ground engaging end are depicted with the elongate body shortened for clarity in accordance with the present invention.
Figure 2:
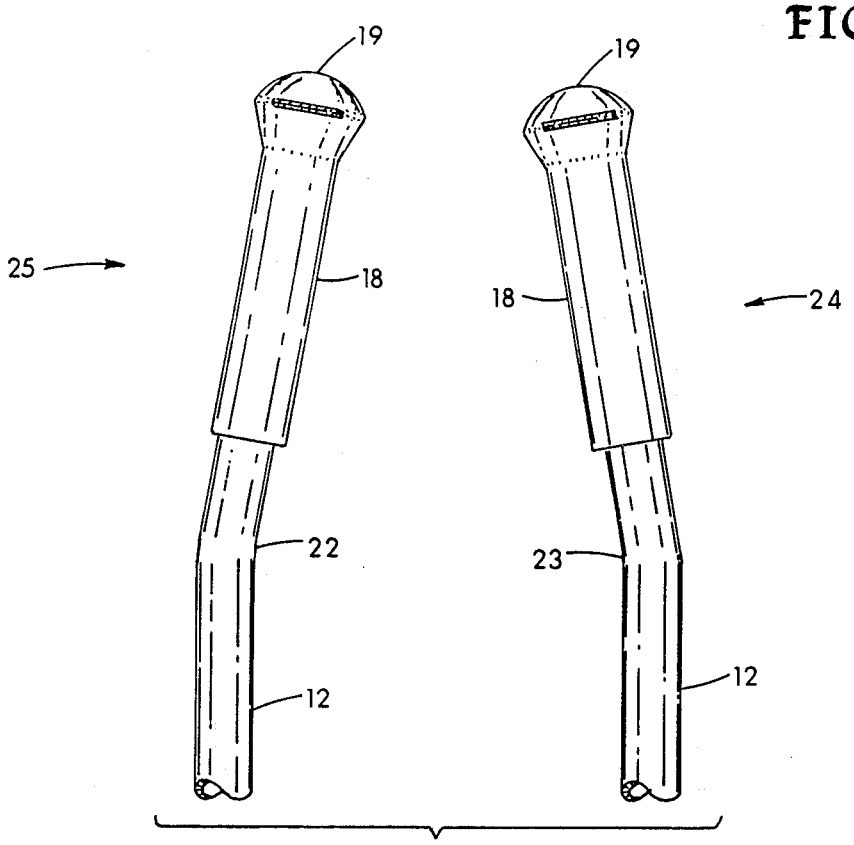
FIG. 2 is a front elevational view of the upper portion of the walking and skiing aid depicting both a left and a right walking and skiing aid depicting the correct twist or inward cant of the upward gripping surface.

The walking and skiing aid apparatus of the instant invention is depicted generally in FIG. 1 in a truncated manner. As can be seen by reference to FIG. 1, the invention 10 provides a tapered, elongated tubular pole or stick 12 having a middle vertical portion 11, upper gripping portion 18 and a lower ground engaging portion 14. As can be seen by reference to FIG. 1, elongate rod 12 is provided with a forward bend 13 to project lower portion 14 forwardly and an upper bend 16 to project upper gripping surface 18 forwardly. Elongate rod 12 is made of tubular material, preferably of a metal such as aluminum having a taper from larger diameter upper portion 18 to smaller diameter lower portion 14 where lower forwardly angled portion 14 is provided with a ground engaging tip 15. Upper gripping surface 18 is further provided with a molded grippable surface 17 which surrounds upper portion 18 and provides an easy, hand grippable length. Upper portion 18 is further provided with wrist engaging strap 20 having an adjustable connection 21 in a manner well known in the art as well as upper molded thumb portion 19 for which the user can place the thumb upon the upper surface in a comfortable manner. Forward bends 13 and 16 are provided to angle lower portion 14 and upper portion 18 forwardly at approximately a 15 degree angle. The 15 degree angle could vary somewhat without departing from the teaching of the invention, but it has been found that the 15 degree bend at the upper handle portion 18 makes for a natural position for the wrist and hand as it approximates the connection angle between the wrist bones and the forearm bones. By having the upper bend at a proper angle, the walker or skier can exert greater pressure through pole 12 against the ground. Furthermore, the force exerted against the ground is more nearly perpendicular to the surface of the ground. By having the lower portion 14 bent forwardly approximately 10 to 20 degrees, the forces are directed immediately, downwardly to the ground, thus providing more thrust than if the lower portion 14 were simply straight. Also, by having the lower portion 14 bent forwardly, the tip 15 is engaged earlier in the walking or skiing stride and remains upon the ground or snow to provide thrust over a greater duration of time. With reference to FIG. 2, it can be seen that besides having the forward canting or angle as shown in FIG. 1, that the invention further provides an inwardly canting. As shown in FIG. 2, poles 24 and 25 correspond to a left pole 25 and right pole 24 each having a gripping portion 18 and an inwardly bend 22 and 23 with respect to middle portion 11.

It has been found that the entire length of the invention 10 as shown in FIG. 1, can be anywhere from 36 inches to 60 inches and that upper portion 18 is approximately 5 to 6 inches in length and lower portion 14 is approximately 3 to 6 inches in length. The tapered rod of the invention while it is preferably made of aluminum tubing could also be made of plastic of fiberglass or any other suitable material.

Continuing with reference to FIG. 2, it can be seen that the angle as made by bends 22 and 23 is approximately 10 degrees to approximate the proper placement of the wrist in a natural position when gripping upper surface 18, but could range between 5 and 15 degrees.

Figure 3:
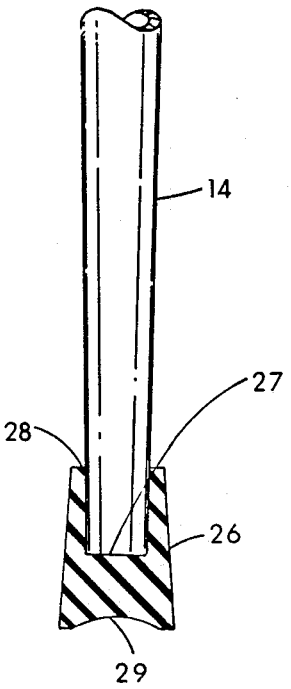
FIG. 3 is a partial cutaway view of the lower ground engaging surface of a walking and skiing aid as used as a walking aid with a resilient tip attached thereto.

With reference to FIG. 3, it can be seen that in one embodiment for use on hard surface such a concrete or within the home that lower portion 14 is further fitted with a rubber tip 26. Tip 26 provides a circular resiliant ground engaging surface 29 which will not mar surfaces and yet provide good friction against concrete, asphalt, and the like. Tip 26 has an inside diameter 28 which will fit about outside diameter 27 of lower portion 14. It has been found that a one-half inch diameter 27 makes a proper size tip. Tip 26 can be made of rubber or any other flexible type of material.

Figure 4:
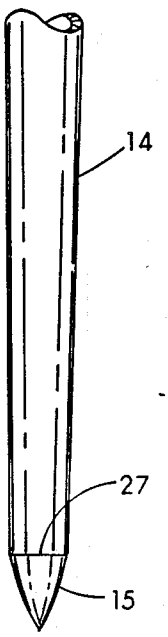
FIG. 4 is a partial cutaway view of the lower ground engaging surface of a walking and skiing aid as used as a walking aid with a pointed ground engaging tip which could be used as either a walking or skiing aid tip.
Figure 5:
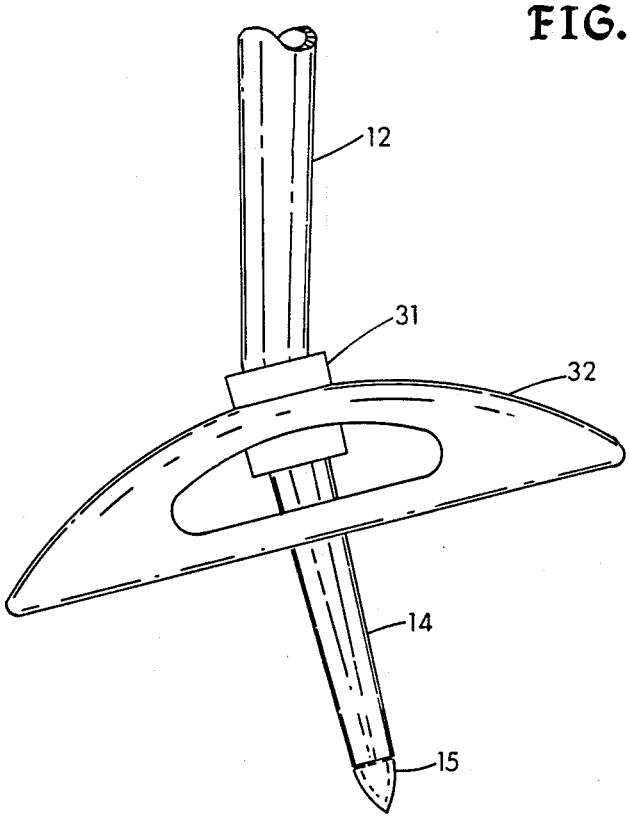
FIG. 5 is a partial right elevational view of the walking and skiing aid when used as a skiing aid depicting a snow engaging basket attached at the lower bend inducing the forward cant.

With reference to FIG. 4, it can be seen that conventional ground engaging tip 15 is attached to lower portion 14. Ground engaging tip 15 is preferably made of a hardened steel or other suitable material which will not wear easily and yet provide a good gripping surface against the ground. Tip 15 is preferably welded or glued into the hollow inside diameter of tip 14. With reference to FIG. 5, it can be seen that lower portion 14 can be further provided with a ski basket 32 attached to lower portion 14 by collar 31 in a manner well known in the art. Tip 15 is also provided in the same manner as previously discussed.

Figure 6:
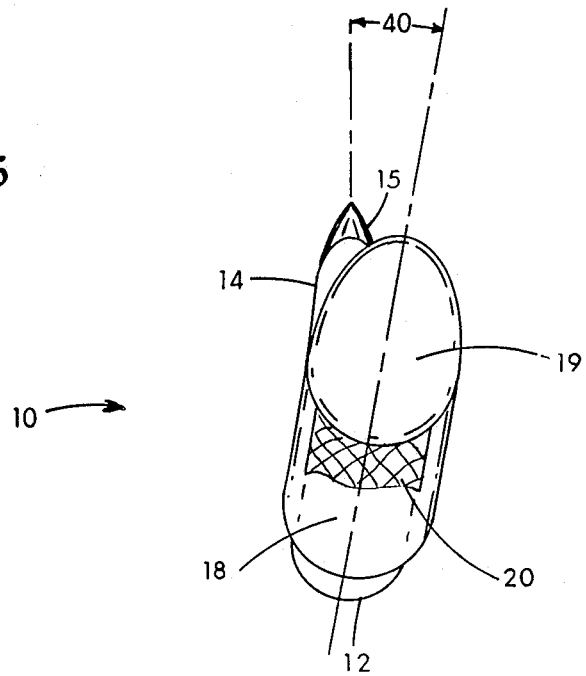
FIG. 6 is a top plan view of the walking and skiing aid depicting the forward cant of the gripping surface, the forward cant of the ground engaging surface, and the inward tilt of the upper gripping surface all in accordance with the present invention.

With reference to FIG. 6, a top view is shown in which the upper portion 18 and lower portion 14 are both canted toward the front and yet the inward slant or twist as discussed with reference to FIG. 2 is shown to be approximately 10 degrees to allow a natural grip.

Figure 7:
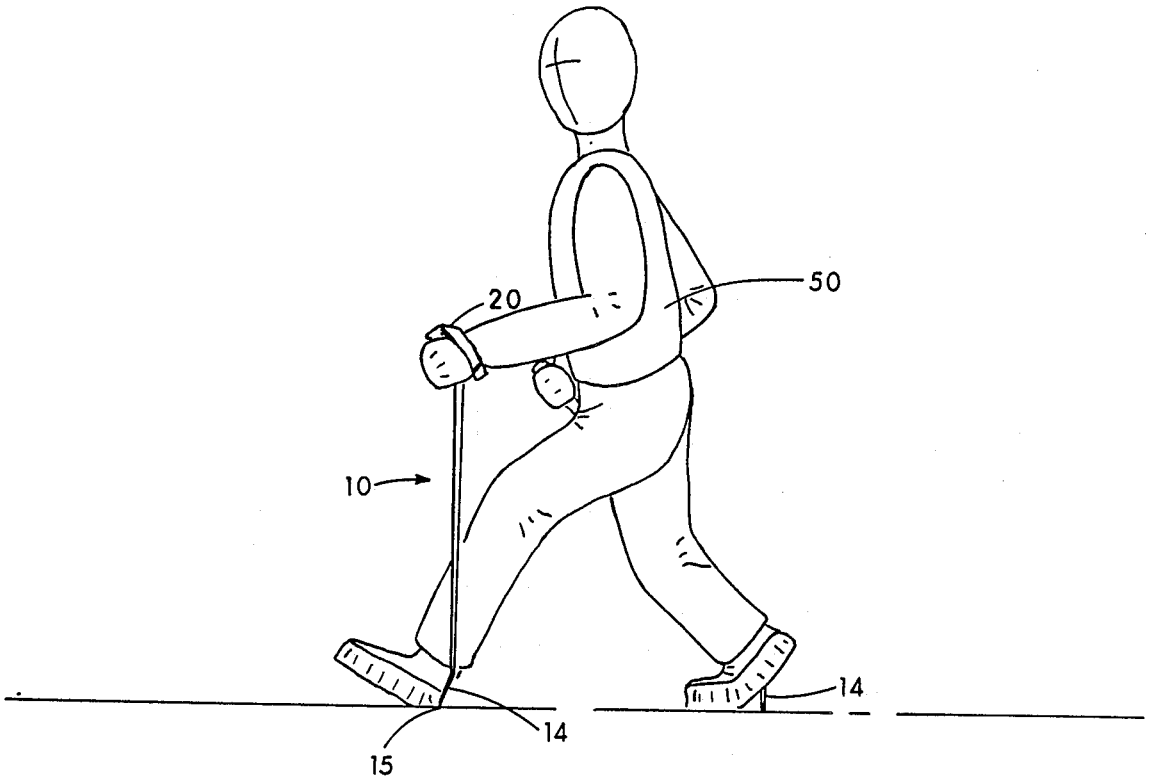
FIG. 7 is a side elevational view of a walking figure utilizing one of the walking and skiing aids in each hand all in accordance with the present invention.

With reference to FIG. 7, a representative user 50 of the walking and skiing aid 10 is shown having the left walking and skiing aid on the left and a right one attached to the right hand with a strap 20 about the wrist. User 50 walks in a normal manner and places the tip 15 against the surface to utilize the muscles of the upper body. By using two of the walking and skiing aids as depicted in FIG. 7, a user 50 can travel up or down in rough terrain and maintain constant balance. Walking and skiing aid 10 could be used by a walker or skier for protection against attacks by dogs, other animals, or even to defend oneself against a mugger.

When used as a walking aid, the ideal situation is to have both the forward angle lower portion 14 and the forward angled gripping portion 18 and inwardly slant on upper portion 18 so that both a right and left pole are utilized. When used by a cross country or Nordic skier, the skiing aid 10 would be lengthened and a snow engaging basket 32 as shown in FIG. 5 would be utilized.

When used by downhill or Alpine skiers, the inward cant could be eliminated so that there would not necessitate a right and a left difference. When used by older people as a walking aid in lieu of conventional walkers or canes, the walking aid 10 would not have inwardly cant as it may be confusing for the user to find a left and a right gripping surface every time that it was used. Nevertheless, by using two of the walking aids an older person would be able to quite readily maintain his balance. When any of the walking or skiing aids are used on a hard surface such a pavement, the resiliant tip 26 would be utilized in lieu of the sharpened point.

Although specific applications, materials, components, connections, sequences of events, and methods have been stated in the above description of the preferred embodiment of the invention, other suitable materials, other applications, components and process steps as listed herein may be used with satisfactory results and varying degrees of quality. In addition, it will be understood that various other changes in details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

I claim:

1. A walking and skiing aid comprising:

an elongated rod having a handgrip adapted to be held in one of the right or left hand by a person having a direction of travel, said rod further having a n upper end portion, a middle portion, and a lower end portion, and wherein said upper end portion is angled forwardly relative to said direction of travel and canted inwardly towards said person from said middle portion when said hand grip is held in said one of said right or left hand and said lower end portion is angled forwardly towards said direction of travel when said hand grip is held in said one of said right or left hand.

2. A walking and skiing aid as described in claim 1 wherein said elongate rod is tapered toward said lower end portion.

3. A walking and skiing aid as described in claim 1 wherein said handgrip is further provided with a wrist engaging adjustable strap.

4. A walking and skiing aid as described in claim 1 wherein said forward angle of said upper end portion and said lower portion from said middle portion is from approximately 10 degrees to 20 degrees with respect to the longitudinal axis of said middle portion.

5. A walking and skiing aid as described in claim 1 wherein said inwardly canted portion is approximately from between 5 degrees and 15 degrees with respect to the longitudinal axis of said middle portion.

6. A walking and skiing aid as described in claim 1 further comprising a ground engaging point attached to said lower end portion.

7. A walking and skiing aid as described in claim 6 wherein said ground engaging tip is comprised of hardened steel.

8. A walking and skiing aid as described in claim 6 wherein said ground engaging portion is comprised of resilient material.

9. A walking and skiing aid as described in claim 1 further comprising a snow engaging basket attached to said lower end portion.

10. A walking and skiing aid as described in claim 1 further comprising a snow engaging ski basket attached to said lower end portion.

11. A walking and skiing aid comprising:

a first and second elongated rods each having a handgrip adapted to be held in one of the right or left hand by a person having a direction of travel said elongated rods each having an upper portion end portion, a middle portion, and a lower end portion, and wherein said upper end portion of each rod is angled forwardly towards said direction of travel and canted inwardly toward said person with respect to said middle portion when each said hand grip is held in said one of said right or left hands, and further wherein each said lower end portion is angled forwardly form said middle portion with respect to said direction of travel when said hand grips are held in said one of said right or left hands.

* * * * *